US008549682B2

(12) United States Patent
Low

(10) Patent No.: US 8,549,682 B2
(45) Date of Patent: Oct. 8, 2013

(54) DUVET COVER ASSEMBLY

(76) Inventor: Madeleine K. Low, Miami, FL (US)

( * ) Notice: Subject to any disclaimer, the term of this patent is extended or adjusted under 35 U.S.C. 154(b) by 0 days.

(21) Appl. No.: 13/115,102

(22) Filed: May 24, 2011

(65) Prior Publication Data

US 2011/0283453 A1 Nov. 24, 2011

Related U.S. Application Data

(60) Provisional application No. 61/347,604, filed on May 24, 2010.

(51) Int. Cl.
*A47G 9/00* (2006.01)

(52) U.S. Cl.
USPC ..... 5/501; 5/502

(58) Field of Classification Search
USPC ..... 5/501, 502; 112/117, 475.08
See application file for complete search history.

(56) References Cited

U.S. PATENT DOCUMENTS

| | | | | |
|---|---|---|---|---|
| 1,261,314 | A * | 4/1918 | Stoddard | 5/501 |
| 2,399,235 | A * | 4/1946 | Leslie | 5/502 |
| 2,544,797 | A * | 3/1951 | Lippmann | 5/502 |
| 4,386,439 | A * | 6/1983 | Roccograndi et al. | 5/498 |
| 4,646,376 | A * | 3/1987 | Sulley | 5/502 |
| 4,903,361 | A * | 2/1990 | Tang | 5/502 |
| 5,243,725 | A * | 9/1993 | Fowler | 5/502 |
| 6,618,881 | B2 * | 9/2003 | Hart et al. | 5/502 |
| 7,181,790 | B2 * | 2/2007 | Wirtz | 5/501 |
| 8,011,038 | B2 * | 9/2011 | Balasundharam | 5/496 |
| 2007/0000053 | A1 * | 1/2007 | Yang | 5/493 |
| 2009/0000032 | A1 * | 1/2009 | Bos | 5/502 |
| 2009/0038521 | A1 * | 2/2009 | Allen | 112/475.17 |
| 2009/0126111 | A1 * | 5/2009 | Maimone et al. | 5/485 |
| 2009/0211060 | A1 * | 8/2009 | Jones et al. | 24/114.4 |
| 2010/0306920 | A1 * | 12/2010 | Balasundharam | 5/496 |

* cited by examiner

*Primary Examiner* — Robert G Santos
*Assistant Examiner* — Myles Throop
(74) *Attorney, Agent, or Firm* — Assouline & Berlow, P.A.; Loren Donald Pearson

(57) ABSTRACT

A duvet cover assembly includes a duvet and duvet cover that appear like a traditional duvet and duvet cover but are connected into a single unit that is entirely machine washable. The duvet cover assembly prevents the duvet from clumping or pooling within the duvet. The duvet cover assembly is useable in home and commercial (e.g. hotel) settings. The duvet cover assembly improves hygiene and shortens the time taken for changing the bedding.

10 Claims, 8 Drawing Sheets

DUVET COVER ASSEMBLY

CROSS-REFERENCE TO RELATED APPLICATIONS

This application claims the benefit of U.S. Provisional Application No. 61/347,604, filed May 24, 2010.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to bedding and duvets.

2. Description of the Related Art

A duvet is a type of bedding, which is traditionally made with a down, wool, silk, or other non-washable filler. Because this filler is not washable, the filler is enclosed in a washable duvet cover.

To improve the hygiene, warmth, texture, and aesthetics, duvet covers are used in conjunction with duvets. A duvet cover is a textile sack that encloses the duvet. The bottom (i.e. the part to be place along the foot of the bed) of the duvet cover has an opening along the bottom edge that is not permanently closed. The duvet can be inserted and removed via the opening in the duvet cover. The duvet is not permanently fixed or secured inside the duvet cover. Typically, the bottom edge of the duvet cover has a top gusset and a bottom gusset. One of the top and the bottom gusset has a plurality of buttons sewn to the gusset. The other gusset has buttonholes formed therein. The one gusset can be buttoned to the other gusset. By including the gusset, the buttons and button holes are not immediately evident when the duvet cover is quickly inspected. A more thorough inspection will reveal the buttons.

Inserting a duvet into a duvet cover is difficult and time consuming. The duvet must be inserted so the corners of the duvet are fully inserted into the respective corners of the duvet cover. When the duvet is larger (e.g. queen or king sized), inserting the duvet properly becomes progressively more complicated, which is reflected in increased time and labor to complete the task of disassembling and reassembling.

In commercial settings such as hotels, the daily replacement of hundreds of duvets into duvet covers can consume a housekeeper's entire day.

As a consequence of the difficulty in removing a duvet cover and reinserting the filler, many people decrease the frequency of washings. Additionally, the non-washable duvet (i.e. the filler) is rarely, if ever, cleaned, resulting in extremely non-hygienic bedding-particularly, in the commercial setting.

Duvets and duvet covers are considered luxury items. Home consumers and hotel guests perceive duvets as luxury items. These benefits outweigh the disadvantages and contribute to the popularity of duvets in homes and hotels.

A need exists for machine washable bedding that provides the aesthetic appeal of a duvet but that is also washable as a single unit that does not require, for each wash, taking the duvet assembly (duvet and duvet cover) apart and then reinserting the duvet into the duvet cover.

DEFINITIONS

Ambiguity in the meaning of duvet-related terms exits. To clarify the meanings, for purposes of this patent application, the following definitions should be used when interpreting this patent application.

Duvet: a comforter including an outer layer or layers holding thermally-insulating filler.

Duvet Cover: a closeable fabric sack for holding a duvet.

Duvet Cover Assembly: the combination of the duvet, the duvet cover, and related devices.

BRIEF SUMMARY OF THE INVENTION

It is accordingly an object of the invention to provide a duvet cover assembly that overcomes the above-mentioned disadvantages of the heretofore-known devices and methods of this general type.

With the foregoing and other objects in view there is provided, in accordance with the invention, a duvet cover assembly. The duvet cover assembly appears like a typical duvet and duvet cover with a placket at its bottom. The placket includes fasteners such as buttons and buttonholes.

The duvet and duvet cover are an assembly and are not to be separated during normal use. Unlike prior-art duvet covers, the bottom edge of the top of the duvet cover is fixed to the bottom edge of the bottom of the duvet cover and is not to be disconnected during normal use, including washing. This connection, at least in part, holds the duvet within the duvet cover. The connection can be between the top and bottom of the duvet cover and can be embodied as stitching that connects the top of the cover to the bottom of the cover along the bottom (footer) edge of the duvet cover. In alternate embodiments, the bottom stitching can be through just the top and the bottom of the duvet cover or the bottom stitching can be through all of the layers including the top and bottom of the duvet cover, the filler, and the skin layers.

The duvet assembly including the duvet and the duvet cover are made of washable material. The duvet assembly can be washed as a unit.

The duvet assembly can include attachments, such as stitching, to hold the layers of the duvet cover in place with the layers of the duvet cover. This prevents the duvet from "pooling" or "clumping" within the duvet cover and assists in drying after washing. A perimeter stitching can be added along the perimeter of the duvet cover and through the layers of the duvet in order to hold the duvet in place with regard to the duvet cover.

Hardware such as gussets, buttons, embroidery, and buttonholes can be added to the bottom edge of the duvet assembly to replicate the appearance of prior-art separable duvet and duvet cover.

Quilt stitching and skin layers can be added to the filler to help maintain the shape of the duvet within the duvet cover. In particular, skin layers and quilt stitching can help to prevent clumping. Examples of materials for a skin layer include polyester and muslin. The stitching can be of any spacing, shape, and even can be decorative.

Other features that are considered as characteristic for the invention are set forth in the appended claims.

Although the invention is illustrated and described herein as embodied in a duvet cover assembly, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
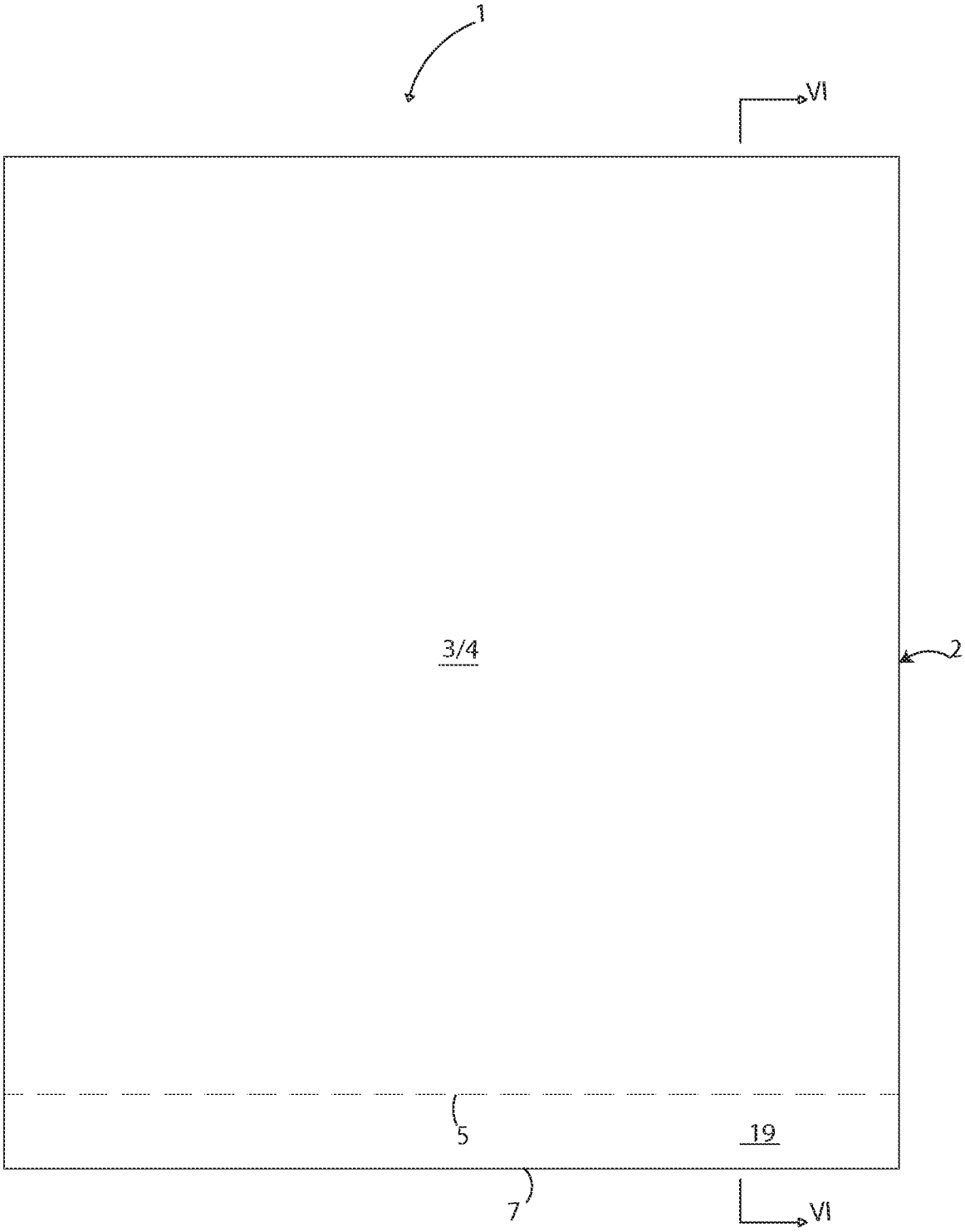
FIG. 1 is a diagrammatic top side view of a duvet assembly according to the invention, the bottom side view of the duvet is identical to the top side view. The dashed lines represent stitching.
Figure 2:
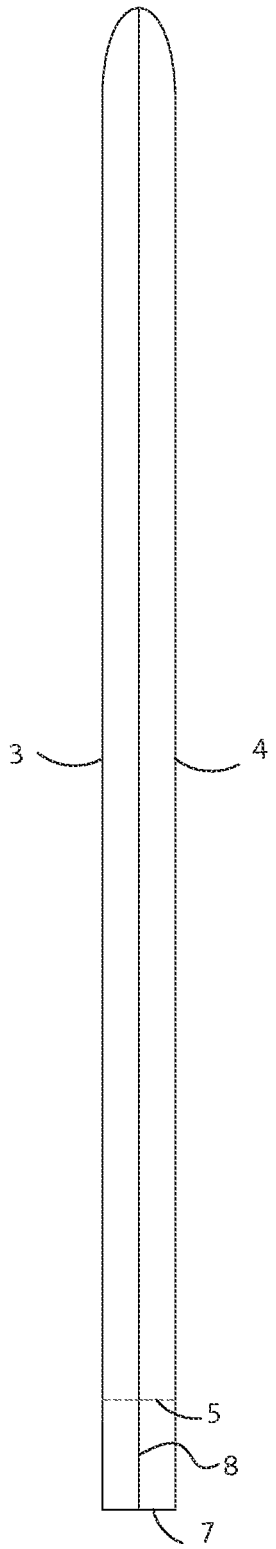
FIG. 2 is a left side view of the duvet assembly shown in FIG. 1; the right side view of the duvet assembly is a mirror image of the left side view. The dashed line represents stitching

Referring now to the figures of the drawing in detail and first, particularly, to FIG. 1 thereof, there is seen a duvet assembly 1. The duvet cover assembly 1 has a duvet cover 2 that houses a duvet 20 (not shown in FIG. 1). The duvet cover 2 is made of a washable textile, preferably a soft bedding material, such as cotton or a cotton blend fabric. The duvet cover 2 is formed from a rectangular top 3 and a rectangular bottom 4 that are joined along their sides and tops to form a seam 8 (as shown in FIG. 2). The seam 8 is preferably a hidden (also known as a "French") seam or a "knife-edge".

Bottom stitching 5 is provided along the portion of the duvet 20 that is to overly the foot of the bed. The bottom stitching 5 runs horizontally (i.e. parallel to the bottom edge 7 of the duvet cover). The bottom stitching 5 joins the top 3 to the bottom 4 and encloses the duvet 20 within the duvet cover 2. The bottom stitching 5 defines a placket 19 portion of the top 3 and the bottom 4 between the bottom stitching 5 and the bottom edge 7. In an alternative embodiment that is not shown, no bottom stitching is included.

Figure 3:
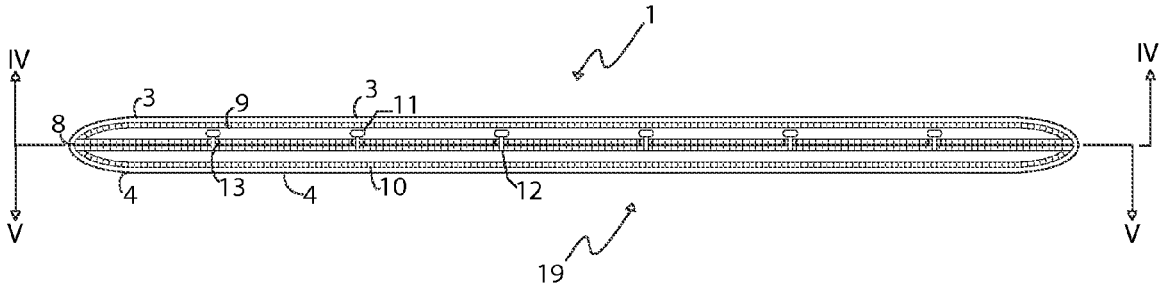
FIG. 3 is a bottom side view of the duvet assembly shown in FIG. 1.

FIG. 3 shows the bottom (i.e. the foot) of the duvet cover assembly 1. Even though the bottom stitching 5 (see FIGS. 1 and 2) is effectively closing the duvet cover 2, the placket 19 appears like a traditional duvet assembly. A top gusset 9 is stitched to the top 3. A bottom gusset 10 is stitched to the bottom 4. Buttons 11 are connected to the bottom gusset 10 by thread shanks 12. Each button 11 is inserted in a respective buttonhole 13 in the top gusset 9.

Figure 7:
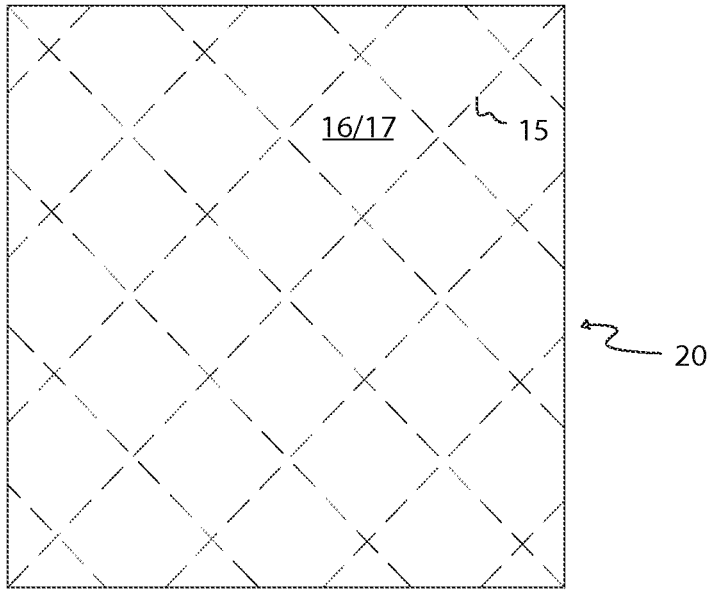
FIG. 7 is a top side view of a duvet according to the invention; the bottom side view of the duvet is identical to the top side view thereof. The dashed line represents stitching.
Figure 8:
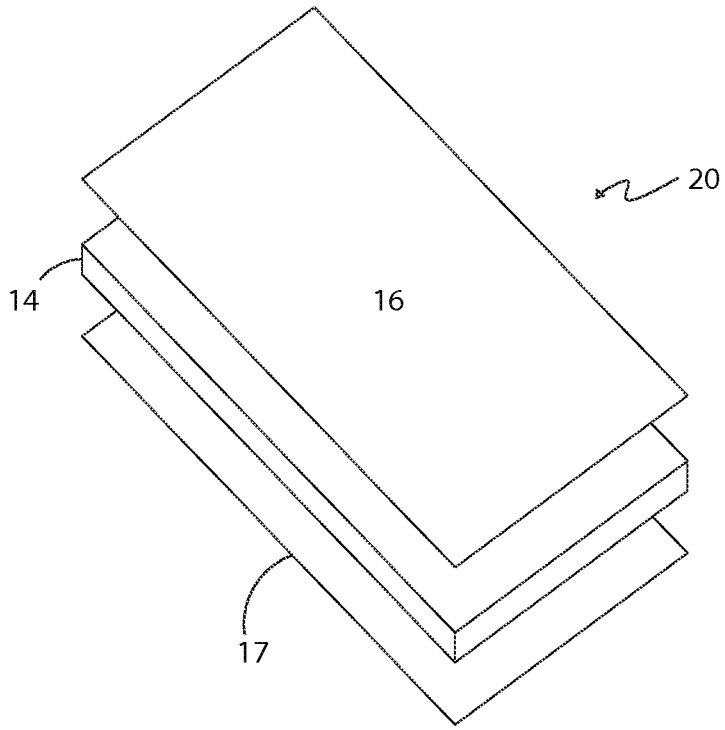
FIG. 8 is an exploded perspective view of the duvet shown in FIG. 7 without the quilt stitching.

To users, the duvet cover assembly 1 looks like a traditional duvet with a bottom closure. The duvet cover uses the same materials as a traditional duvet cover in order to provide the duvet cover assembly 1 with the same tactile feel. FIGS. 7-8 show the duvet 20. As shown in FIG. 8, the duvet 20 includes three layers: a top skin layer 16, a filler layer 14, and a bottom skin layer 17. The filler layer 14 is preferably polyfill. Polyfill is a tangled polyester fiber mass. The top and bottom skin layers 16 and 17 are thin layers of skin that have the shape (i.e. horizontal cross section) of the duvet 20. FIG. 7 shows the duvet in its assembled state. Diamond-shaped quilt stitching 15 is used to connect the top layer 16 to the bottom layer 17. Other patterns for the quilt stitching 15 are possible. The skin layers 16, 17 in conjunction with quilt stitching 15 tend to hold the duvet 20 in a flat (i.e. unfolded or uncrumpled) configuration within the duvet cover 2.

Figure 4:
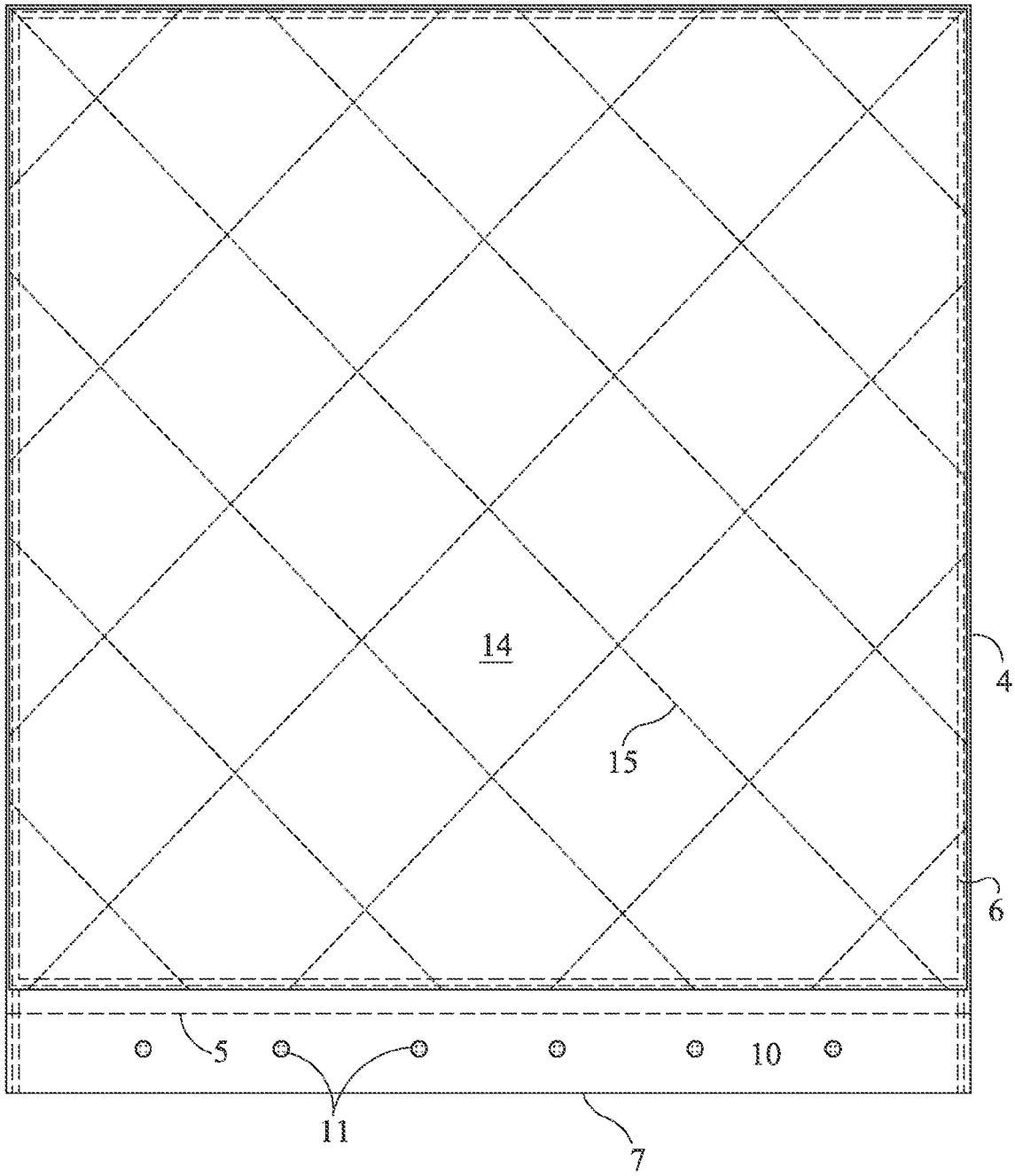
FIG. 4 is a top sectional view of the duvet assembly taken along line IV-IV shown in FIG. 3.
Figure 5:
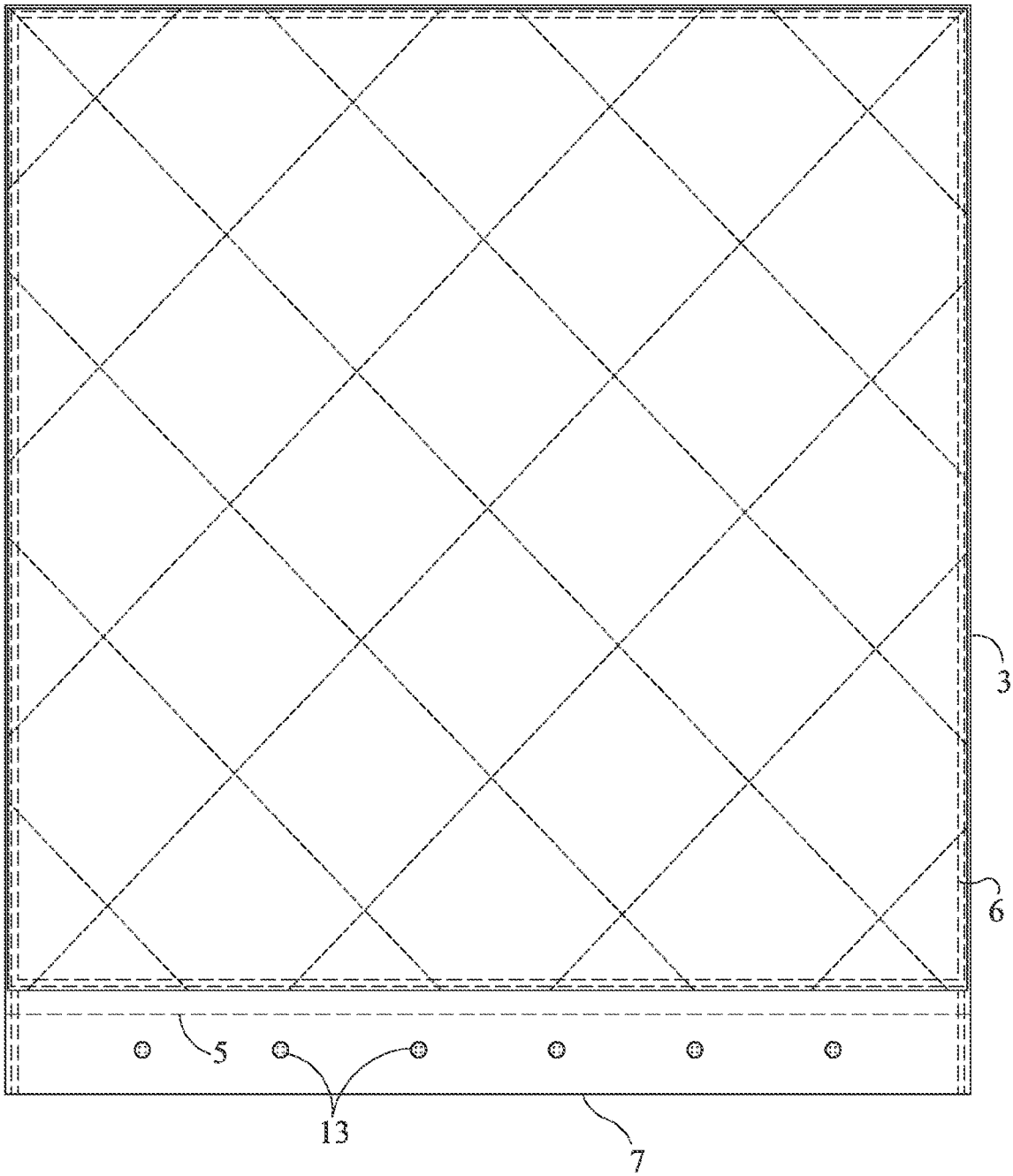
FIG. 5 is a bottom sectional view of the duvet assembly taken along line V-V shown in FIG. 3. The dashed lines represent stitching.

As shown in FIGS. 4-5, in the preferred embodiment, the duvet 20 is attached to the duvet cover 2. A perimeter stitching 6 is used to secure a perimeter of the duvet 20 to the bottom 4 (FIG. 4) and top 3 (FIG. 3). The perimeter stitching 6 holds the duvet 20 in place with respect to the duvet cover 2 so that the duvet 20 does not shift or clump within the duvet cover 2.

Figure 6:
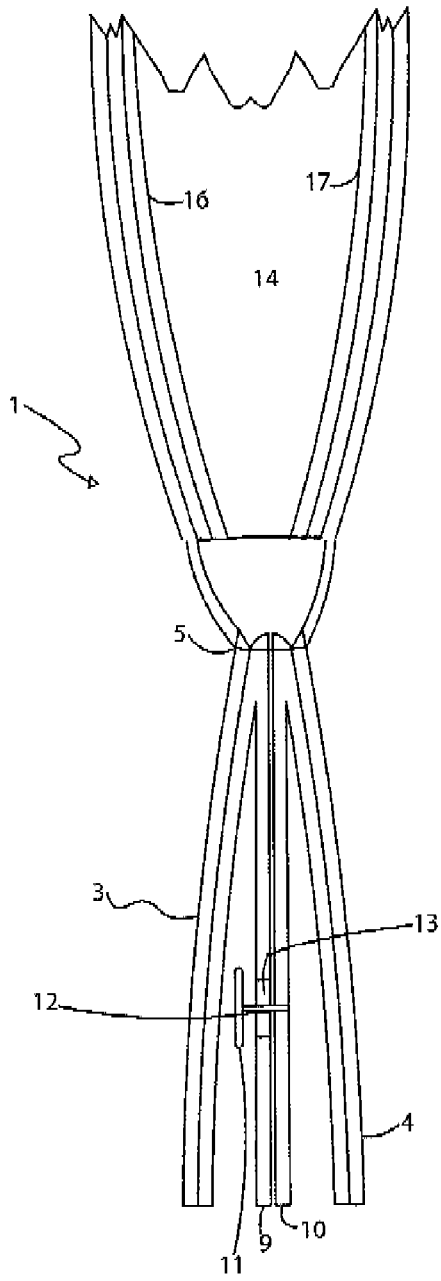
FIG. 6 is side sectional view of the duvet assembly taken along line VI-VI shown in FIG. 1.

FIG. 6 shows a sectional view of the duvet cover assembly 1. The bottom stitching 5 is shown attaching the top 3 to the bottom 4 including the top gusset 9 and bottom gusset 10.

The duvet cover assembly 1 can be used as bedding in commercial settings, such as hotels, cruise ships, hospitals, and dormitories. Because the entire duvet cover assembly 1 is made of washable material, the duvet cover assembly 1 is removed from the bed while in one piece (i.e. without removing the duvet from the duvet cover 2). So, a preferred embodiment of a method of using the duvet cover assembly includes not removing the duvet from the cover before washing. And, when washing the duvet, the duvet 20 remains held within the duvet cover 2. Then, the duvet cover assembly 1 is washed and dried. The housekeeper then makes the bed by placing the duvet cover assembly 1 onto the bed. The housekeeper does not need to spend time removing the duvet 20 from the duvet cover 1 and then reinserting the duvet 20 into the duvet cover 1. The entire bedding is washed including the duvet 20, and not just the duvet cover 2. The time savings is aggregated across the number of beds that the housekeeper must change.

Another embodiment of a method of using the duvet cover assembly 1 is in a residential setting. The duvet cover assembly 1 has improved hygiene compared to conventional duvets because the entire unit including the duvet 20 is washable. In addition, because the duvet 20 is connected to the duvet cover 2, the person changing the bedding does not need to struggle with inserting the duvet 20 fully into the top corners (i.e. opposing the bottom edge 7) of the duvet cover 2. Another advantage is that the duvet 20 does not pool, clump, or shift because the duvet 20 is held in place with regard to the duvet cover 2 by the perimeter stitching 6.

The duvet cover assembly 1 is made from machine washable fabrics. The duvet cover 2 is preferably made from a sheet of cotton fabric or cotton blend fabric. The duvet cover can be dyed, stitched, woven, etc. with any desired appearance. The bottom stitching 5, perimeter stitching 6, and hidden seam 8 are made with thread. The top gusset 9 and bottom gusset 10 are preferably made with materials that match the duvet cover 2; different materials with contrasting patterns are possible. The buttons 11 provide a desired aesthetic and can be changed to create whatever desired appearance the duvet cover assembly 1 is to create. The buttons 11 do act to hold the top gusset 9 and bottom gusset 10 together. In the preferred embodiment, the buttons 11 do not need to act to hold the duvet 20 in the duvet cover 2 because the duvet 20 is held within the duvet cover 2 by other devices, namely, the bottom stitching 5. The buttons 11 can be made of any material including mother of pearl, a plastic resin, and brass. The filler 14 is preferably a polyfill, which is a polyester thread spun into a voluminous body. The filler 14 can be made of other machine-washable insulating materials. The top and bottom layers 16 and 17 of the duvet 20 are made from sheets of fabric that is stiff enough to shape the underlying filler 14. A preferred material for the top and bottom skin layers 16 and 17 is a non-shrinking washable fabric such as polyester. An alternative embodiment uses a cotton fabric, most preferably muslin, as the skin layers 16, 17.

Figure 9:
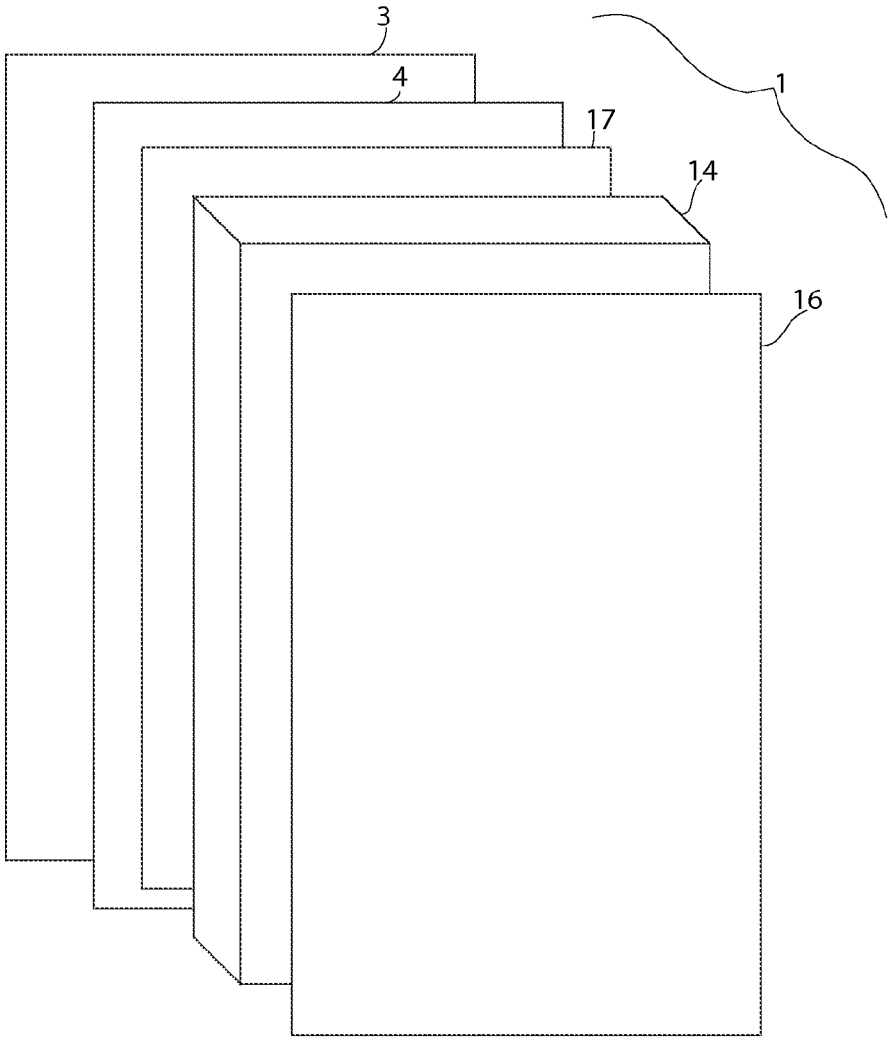
FIG. 9 is an exploded view of the duvet cover assembly before the top and bottom of the cover have been inverted.
Figure 10:
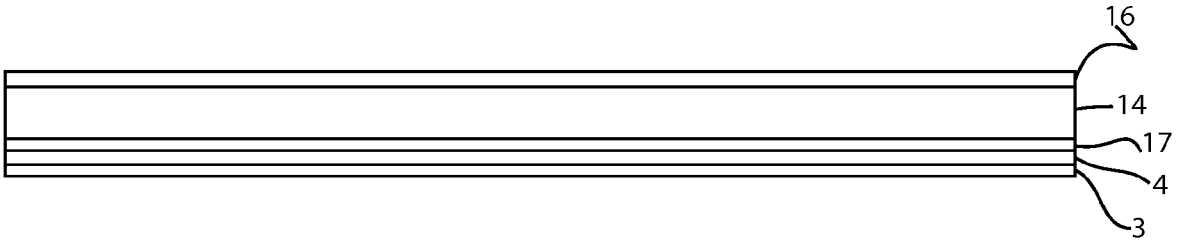
FIG. 10 is a top side view of the duvet cover assembly shown in FIG. 9 before the top and bottom of the cover have been inverted.

As shown in FIGS. 9 and 10, the duvet cover assembly 1 is preferably manufactured according to the following method. The top 3 of the duvet cover 20 and the bottom 4 of the duvet cover 4 are placed face up and side by side. Next, the top 3 and the bottom 4 are placed on top of each other, with the faces that are ultimately to be the exterior facing inward, toward each other. Next, the duvet 20 (including the filling 14 and the top skin layer 16 and bottom skin layer 17) are placed on top of the already stacked top 3 and bottom 4. The perimeter stitching 6 is started through all five layers: the top 3, the bottom 4, the filler 14, the top skin layer 16, and the bottom skin layer 17. The perimeter stitching 6 is around three sides of the perimeter leaving only one (usually the bottom, i.e. foot) unstitched and open. Next, the assembly is reversed by pulling the assembly inside out by reaching through the open end and, grasping the inside top, and pulling the layers through the open bottom. The bottom stitching 5 is added near the bottom edge 7. The bottom stitching 5 is formed near the bottom edge 7 (i.e. within the bottom edge 7 but not through the duvet 20) to define the placket 19. The top gusset 9 is sewn onto placket 19 of the top 3. The bottom gusset 10 is sewn onto the placket 19 of the bottom 4. The buttons 11 are attached to the bottom gusset 19 with thread shanks 12. Buttonholes 13 are formed in the top gusset 8. Each of the buttons 11 is inserted into a respective one of the buttonholes 13.

Through the embodiments that are illustrated and described, the currently contemplated best mode of making and using the invention is described.

What is claimed is:

1. A duvet cover assembly, comprising:

a rectangular duvet including a top skin layer, a polyester filler layer, and a bottom skin layer;

a rectangular duvet cover including a top and a bottom, said rectangular duvet cover having a top edge, a bottom edge, a left edge, and a right edge, said top and said bottom being stitched together to form a seam; said duvet cover holding said duvet between said top and said bottom;

a bottom stitching being formed parallel to said bottom edge of said duvet and connecting said top to said bottom and defining a placket between said bottom stitching and said bottom edge, said bottom stitching being configured to hold said duvet within said duvet cover;

a rectangular perimeter stitching within said top edge, said right edge, said bottom stitching, and said left edge; said rectangular perimeter stitching being sewn through said top, said top skin layer, said filler, said bottom skin layer, and said bottom;

a top gusset being connected to said top in said placket;

a bottom gusset being connected to said bottom in said placket and having a given number of buttonholes formed therein; and a given number of buttons equaling said number of buttonholes sewn to said top gusset, each of said button being inserted into a respective one of said buttonholes.

2. A duvet cover assembly, comprising:

a duvet;

a rectangular duvet cover including a top and a bottom, said duvet cover having a top edge, a left edge, a right edge, and a bottom edge, said duvet cover holding said duvet between said top and said bottom; said top and said bottom defining a placket along said bottom edge;

a first permanent connector connecting at least one of said top and said bottom to said duvet, said first permanent connector being a rectangular perimeter stitching within said top edge, said right edge, and said left edge; said rectangular perimeter stitching being sewn through said top, said filler, and said bottom;

a second permanent connector connecting said top and said bottom, said second permanent connector being configured to hold said duvet within said duvet cover, said second permanent connector not fixing said duvet to said top or to said bottom.

3. The duvet cover assembly according to claim 2, wherein said duvet includes polyester filler and quilt stitching, said quilt stitching being sewn through said polyester filler.

4. The duvet cover assembly according to claim 2, wherein said second permanent connector is stitching.

5. The duvet cover assembly according to claim 4, wherein said stitching runs parallel to said bottom edge.

6. The duvet cover assembly according to claim 2, wherein said stitching is through said top and said bottom.

7. The duvet cover assembly according to claim 4, wherein said stitching is not through said duvet.

8. A duvet cover assembly, comprising:

a duvet;

a rectangular duvet cover including a top and a bottom, said duvet cover having a top edge, a left edge, a right edge, and a bottom edge, said duvet cover holding said duvet between said top and said bottom; said top and said bottom defining a placket along said bottom edge;

a first permanent connector connecting at least one of said top and said bottom to said duvet;

a second permanent connector connecting said top and said bottom, said second permanent connector being configured to hold said duvet within said duvet cover, said second permanent connector not fixing said duvet to said top or to said bottom; and a top gusset being connected to said top in said placket.

9. The duvet cover assembly according to claim 8, further comprising a bottom gusset being connected to said bottom in said placket.

10. The duvet cover assembly according to claim 9, wherein:

said bottom gusset has a buttonhole formed therein; and a button is sewn to said top gusset, said button being inserted into said buttonhole.

* * * * *